United States Patent [19]

Fisher, Jr.

[11] 4,352,366

[45] Oct. 5, 1982

[54] VELOCITY OPERATED STANDING VALVE

[75] Inventor: Ernest P. Fisher, Jr., Carrollton, Tex.

[73] Assignee: Otis Engineering Corporation, Dallas, Tex.

[21] Appl. No.: 118,722

[22] Filed: Feb. 5, 1980

[51] Int. Cl.[3] ..... F16K 13/04

[52] U.S. Cl. ..... 137/71; 137/464; 137/596.2; 251/63.4; 166/3.7; 166/321

[58] Field of Search ..... 137/70, 71, 271, 596.1, 137/596.2, 464; 251/63.4; 166/317, 721

[56] References Cited

U.S. PATENT DOCUMENTS

| | | | |
|---|---|---|---|
| 2,124,359 | 7/1938 | Weisgerber | 137/271 X |
| 2,330,267 | 9/1943 | Burt | 137/71 |
| 2,999,513 | 9/1961 | Oetiker | 137/596.1 |
| 3,721,264 | 3/1973 | Coughlin | 137/596.2 |
| 4,121,483 | 10/1978 | Sedlock | 137/71 X |

*Primary Examiner*—Harold W. Weakley
*Attorney, Agent, or Firm*—Thomas R. Felger

[57] ABSTRACT

A standing valve for controlling fluid flow through a well flow conductor. The standing valve allows formation fluids to enter the flow conductor downhole and to flow in one directin to the well surface. The standing valve functions as a check valve to prevent fluids injected into the flow conductor at the well surface from flowing out the other end of the well flow conductor. The standing valve is operated by changes in the velocity of fluids flowing through the valve. When the pressure of fluid injected into the flow conductor from the well surface exceeds a preselected value, an alternative flow path is opened within the standing valve to allow the injected fluid to flow in the other direction through the valve.

16 Claims, 5 Drawing Figures

VELOCITY OPERATED STANDING VALVE

BACKGROUND OF THE INVENTION

1. Field of the Invention

Standing valves are frequently installed in the lower end of well flow conductors to act as one way check valves. A typical standing valve allows formation fluids within a well bore to flow into the well flow conductor and through the well flow conductor to the well surface. The standing valve prevents fluids injected into the well flow conductor at the well surface from flowing out the lower end thereof and into the formation surrounding the well bore.

2. Description of the Prior Art

Otis Engineering Corporation Pumpdown Completion Equipment & Service Catalog (OEC 5113A) shows on page 12 examples of standing valves used in pumpdown well completions. A typical standing valve is shown on page 24 of this stame catalog.

U.S. Pat. No. 3,603,394 invented by George Max Raulins shows a combination standing valve and velocity operated safety valve. U.S. Pat. No. 3,603,394 is incorporated by reference for all purposes in this patent application.

SUMMARY OF THE INVENTION

This invention discloses a valve for controlling fluid flow through a well flow conductor comprising a housing; means for securing the housing to the flow conductor; a longitudinal flow passage extending through the housing; a valve closure means disposed within the longitudinal flow passage having a first position blocking fluid flow therethrough, a second position allowing fluid communication through the longitudinal flow passage and the valve closure means, and a third position allowing fluid to communicate between the longitudinal flow passage and the exterior of the housing; an operating sleeve slidably disposed within the longitudinal flow passage forming a part of the valve closure means to shift the valve closure means between its first and second positions; means for biasing the operating sleeve to shift the valve closure means to its first position; and means for forming a seal with the valve closure means preventing fluid flow in the other direction through the longitudinal flow passage when the valve closure means is in its first position.

One object of the present invention is to provide a valve for allowing fluid flow in one direction through a well flow conductor and for blocking fluid flow in the other direction through the well flow conductor.

Another object of the present invention is to provide a valve which is held opened by fluid flow in one direction and closes when the fluid flow decreases below a preselected value.

Still another object of the present invention is to provide a valve which blocks fluid from flowing in the other direction through a well flow conductor until the difference in fluid pressure in the other direction exceeds a preselected value and opens an alternative flow path from the interior of the valve to its exterior.

A further object of the present invention is to provide a means for protecting the valve closure means when fluid pressure moves the valve closure means to open the alternative flow path.

An additional object of the present invention is to provide a velocity operated ball valve with the means for regulating fluid flow disposed within the ball member. The regulating means can be easily changed without having to completely disassemble the valve.

Other objects and advantages of the present invention will become readily apparent to those skilled in the art from reading the following description in conjunction with the accompanying drawings illustrating the present invention.

DESCRIPTION OF THE PREFERRED EMBODIMENT

Figure 1A:
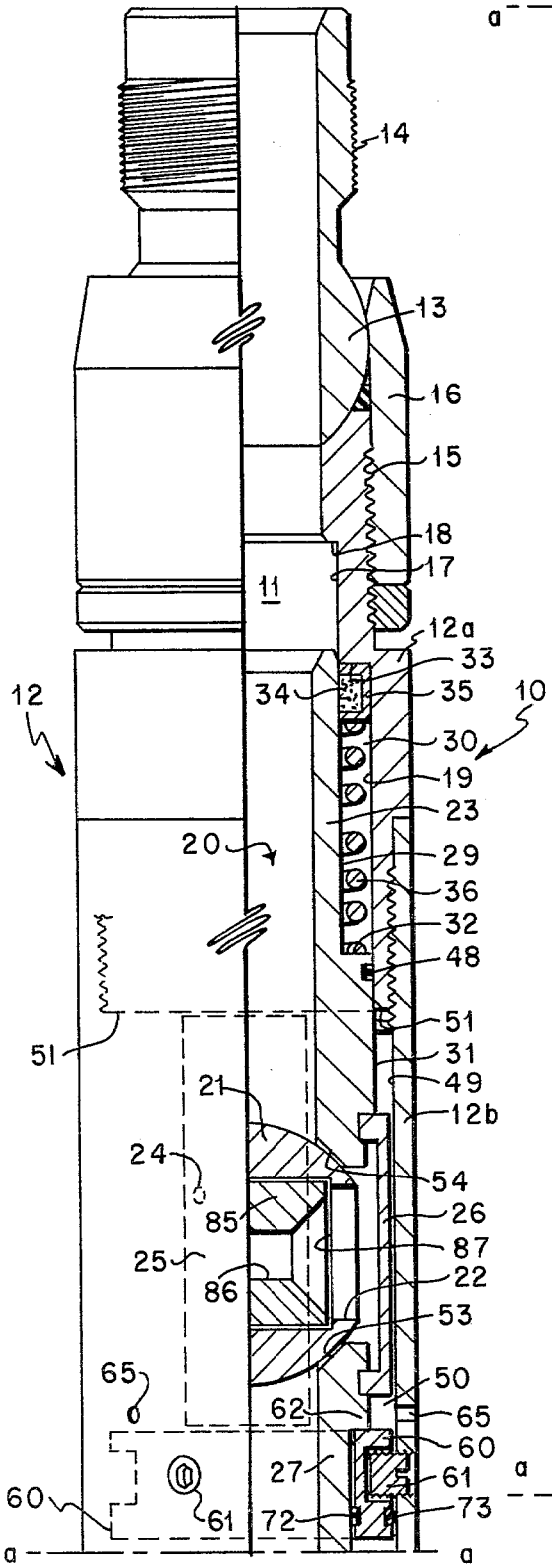
FIG. 1A, partially in section and partially in elevation, shows a portion of a standing valve incorporating the present invention with the valve closure means in its first position.
Figure 1B:
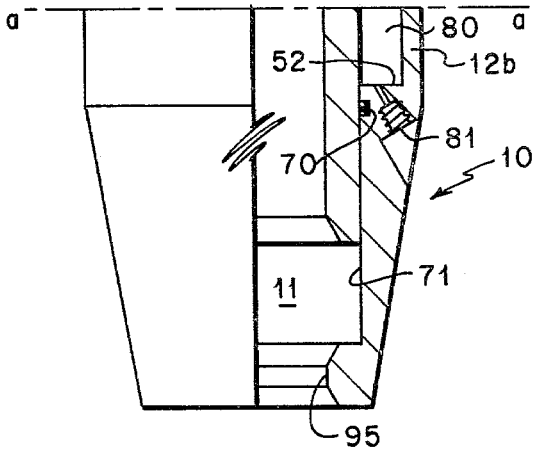
FIG. 1B, partially in section and partially in elevation, shows a portion of the variable volume chamber from which high viscosity liquid is extruded when the valve closure means is moved to its third position.

Referring to the drawings and specifically FIGS. 1A and 1B, a standing valve incorporating the present invention is generally designated by the reference numeral 10. Valve 10 comprises a generally cylindrical housing 12 having a plurality of subassemblies which are engaged by threads to each other. Longitudinal flow passage 11 extends through valve 10. Standing valve 10 is shown with valve closure means 20 in its first position with ball member 21 blocking fluid flow through longitudinal flow passage 11. When valve 10 is installed within a well bore (not shown), flow passage 11 is axially aligned with the bore of a tubing string or well flow conductor (not shown) to direct formation fluids from downhole to the well surface.

Figure 2A:
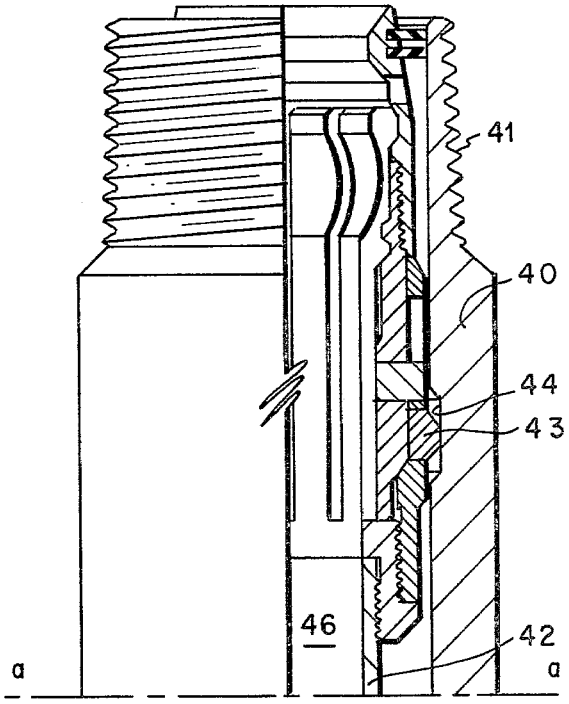
FIG. 2A, partially in section and partially in elevation, shows a landing nipple comprising a portion of a well flow conductor with a locking mandrel secured therein.
Figure 2B:
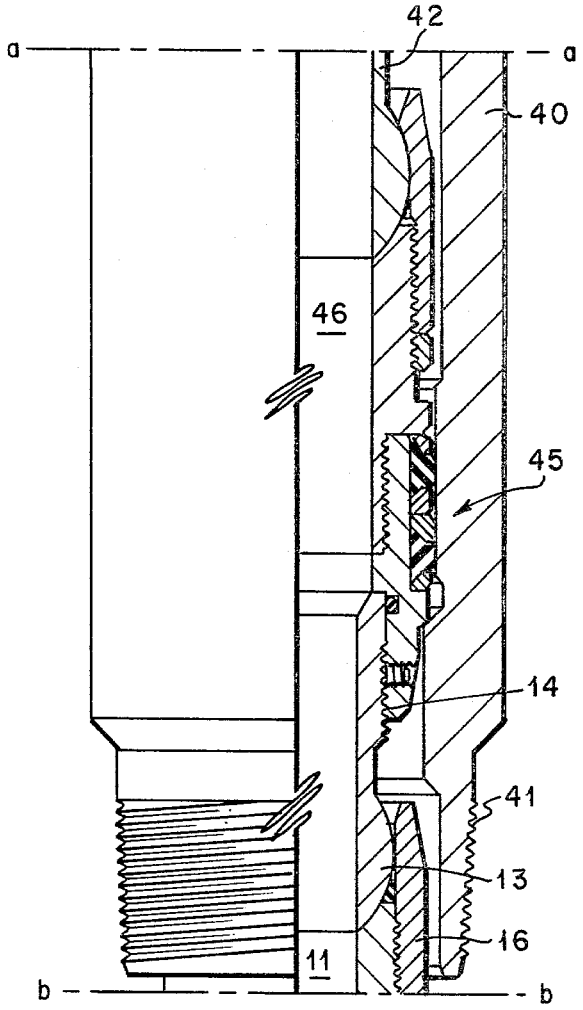
FIG. 2B, partially in section and partially in elevation, shows the connection between the locking mandrel and the standing valve within the landing nipple.

A well flow conductor generally includes one or more landing nipples 40 which are secured by threads 41 into the tubing string (not shown). Referring to FIGS. 2A, B, and C, standing valve 10 is shown attached by knuckle or swivel joint 13 at one end thereof to locking mandrel 42. Dogs or lugs 43 anchor locking mandrel 42 within the bore of landing nipple 40 by engaging locking grooves or recesses 44, formed in the inside diameter of landing nipple 40. Locking mandrel 42, landing nipple 40, and swivel joint 13 are particularly adapted for pumpdown installation and retrieval of standing valve 10. Such pumpdown equipment and techniques are fully explained in U.S. Pat. No. 3,863,715 to John H. Yonker which is adopted by reference for all purposes. Standing valve 10 could also be attached to a standard wireline locking mandrel or attached directly to the lower end of a well flow conductor.

Packing means 45 is carried on the exterior of locking mandrel 42 and forms a fluid tight seal with the inside diameter of nipple 40. Packing means 45 directs fluid flow through longitudinal bore 46 of locking mandrel 42. Longitudinal flow passage 11, bore 46, and the bore of the tubing string are axially aligned to communicate fluids therethrough. Under normal operating conditions, formation fluids would enter opening 95 in the other end of valve 10 and flow through longitudinal flow passage 11 in one direction and into the well flow conductor.

Referring to FIG. 1A, swivel joint 13 with threads 14 on one end thereof comprises part of the means for securing housing 12 to the inside diameter of landing nipple 40. Operating sleeve 23 is slidably disposed within longitudinal flow passage 11. Sleeve 23 forms a part of valve closure means 20 and transmits force to ball member 21 to rotate ball member 21 from its second position to its first position. Various methods and structures aare well known in the prior art for using a sliding sleeve to operate a downhole valve. Examples of such prior art are U.S. Pat. No. 3,126,908 to George C. Dickens; U.S. Pat. No. 3,273,588 to William W. Dollison; and U.S. Pat. No. 3,398,762 to John V. Fredd. These patents are incorporated by reference for all purposes.

Spring housing subassembly **12*a* has threads 15 formed on its exterior near one end thereof. Swivel cap 16 has matching threads 15 on its inside diameter and secures swivel joint 13 to housing subassembly 12*a*. Longitudinal flow passage 11 has a first enlarged inside diameter 17 which is compatible with first outside diameter portion 29 of operating sleeve 23. Inside diameter 17 forms shoulder 18 which defines the maximum length of travel of valve closure means 20 in the one direction within flow passage 11. A second enlarged inside diameter 19 is formed within housing subassembly 12*a* adjacent to inside diameter 17. Inside diameter 19 is larger than the first outside diameter portion 29 of operating sleeve 23. Annulus 30 is formed between outside diameter 29 and inside diameter 19. The second outside diameter portion 31 of operating sleeve 23 is larger than first outside diameter 29 forming shoulder 32 on the exterior of operating sleeve 23. An opposing shoulder 33 is formed by inside diameter 17 and 19 within housing subassembly 12*a*. Felt wiper ring 34 surrounds first outside diameter portion 29 of operating sleeve 23. Felt wiper ring 34 is contained by metal carrier 35 within annulus 30. One side of carrier 35 abuts shoulder 33. Spring 36 is disposed within annulus 30 between the other side of carrier 35 and shoulder 32. Spring 36 comprises a portion of the means for biasing operating sleeve 23 to shift valve closure means 20 from its second position to its first position. Felt wiper 34 does not form a fluid tight seal with the exterior of operating sleeve 23 but rather forms a barrier to prevent solid particles such as sand from accumulating in annulus 30**.

First seal or T seal 48 is carried on second outside diameter portion 31 of operating sleeve 23 spaced longitudinally from shoulder 32. T seal 48 forms a fluid tight seal with the second enlarged diameter 19 of housing 12. When valve closure means 20 shifts between its first and second position, T seal 48 remains in constant contact with inside diameter 19.

Housing subassembly **12*b* is secured to threads on the exterior of subassembly 12*a* opposite inside diameter 19. Housing subassembly 12*b* has an enlarged inside diameter 49 as compared to inside diameter 19. Thus, recess 50 within the inside diameter of housing 12 is partially defined by inside diameter 49, end 51 of housing subassembly 12*a*, and shoulder 52 within housing subassembly 12*b***.

Preferably, ball member 21 is engaged by two opposed actuator pins 24 which are each attached to a separate actuator member or plate 25. One actuator member 25 and pin 24 are shown by dotted lines in FIG. 1A. The construction and purpose of actuator pin 24, actuator member 25 and connector member 26 are more fully explained in U.S. Pat. No. 3,398,762.

The exterior of ball member 21 is engaged by support sleeve 27 opposite operating sleeve 23. Connector member 26 secures operating sleeve 23 to support sleeve 27 with ball member 21 trapped therebetween. Therefore, any longitudinal movement of operating sleeve 23, support sleeve 27, and/or ball member 21 within longitudinal flow passage 11 results in valve closure means 20 moving as a single unit. Support sleeve 27 carries a sealing surface 53 which forms a fluid tight seal with the exterior of ball member 21 when valve closure means 20 is in its first position. Support sleeve 27 and sealing surface 53 provide a means for forming a seal with valve closure means 20 preventing fluid flow in the other direction through longitudinal flow passage 11 when valve closure means 20 is in its first position.

Preferably, the end of operating sleeve 23 which engages ball member 21 has a similar sealing surface 54 formed thereon. A fluid tight seal is not required between the exterior of ball member 21 and operating sleeve 23 when valve closure means 20 is in its first position. However, sealing surface 54 ensures smooth rotation and alignment of ball member 21 as valve closure means 20 moves between its first and second position. As will be explained later, lateral ports 65 allow formation fluid exterior to housing 12 to communicate with recess 50 in which ball member 21 is disposed. When valve closure means 20 is in its second position, a pressure drop occurs as formation fluid flows in the one direction through bore 22 of ball member 21. Thus, fluid pressure within operating sleeve 23 is less than the fluid pressure in recess 50. Sealing surface 54 prevents fluid flow between the higher fluid pressure in recess 50 and the lower fluid pressure within operating sleeve 23 when valve closure means 20 is in its second position.

Support sleeve 27 is a generally cylindrical tube with a uniform bore therethrough and is slidable through releasing ring 60. Support sleeve 27 is sized to slide within the inside diameter of ring 60 as valve closure means 20 moves between its first and second positions. Releasing ring 60 is releasably secured to housing 12 within recess 50 by shear screws 61. When a predetermined amount of force is applied to ring 60, screws 61 will shear allowing ring 60 to move within recess 50 until ring 60 contacts shoulder 52. Flange 62 is formed on the exterior of support sleeve 27 at the same end as sealing surface 53. Flange 62 projects into recess 50 and forms shoulder 63 which engages an opposing shoulder 64 on ring 60 preventing support sleeve 27 from sliding completely through ring 60. Shear screws 61 hold releasing ring 60 fixed relative to housing 12 during movement of valve closure means 20 between its first and second positions. A plurality of lateral ports 65 extend through housing 12 within recess 50. Lateral ports 65 are spaced longitudinally from end 51 and the contact between first seal 48 and inside diameter 19. Fluids surrounding the exterior of housing 12 can communicate with recess 50 through lateral ports 65.

Second seal or T seal 70 is carried on the reduced inside diameter 71 of housing subassembly **12*b* spaced longitudinally from shoulder 52. Second seal 70 prevents fluid flow between the exterior of support sleeve 27 and reduced inside diameter 71. Releasing ring 60 carries a third seal or T seal 72 on its inside diameter which forms a fluid tight barrier with the exterior of support sleeve 27. Fourth seal 73 is carried on the outside diameter of releasing ring 60 and forms a fluid tight seal with inside diameter 49 of housing subassembly 12***b*. Second seal 70, third seal 72, fourth seal 73, a portion of the exterior of support sleeve 27, and a portion of inside diameter 49 partially define a variable volume chamber 80 within a portion of recess 50. Lateral ports 65 are spaced longitudinally from and do not communicate with variable volume chamber 80. An oblique opening 81 is provided from the exterior of housing 12 into variable volume chamber 80. Preferably, variable volume chamber 80 is filled with a high viscosity liquid such as grease.

As previously noted, ball member 21 is rotatably disposed between operating sleeve 23 and support sleeve 27. Two actuator plates or members 25 are positioned on opposite sides of ball member 21. A pin 24 projects from each plate 25 and engages ball member 21 eccentric from the axis of valve 10. Plates 25 are segments of a cylinder. Each plate 25 is positioned between end 51 of housing subassembly 12*a* and releasing ring 60. As long as releasing ring 60 is secured to inside diameter 49 of housing 12, plates 25 cannot move relative to housing 12. Thus, ball member 21 can rotate about pins 24 as operating sleeve 23 and support sleeve 27 move longitudinally within flow passage 11.

Ball member 21 has an axial bore 22 machined therethrough. Preferably, a flow regulating device such as bean choke or flow bean 85 is installed within bore 22. Bore 22 has a reduced inside diameter portion near one end which defines shoulder 87. The remainder of bore 22 is slightly larger than the outside diameter of choke 85 so that choke 85 can be easily fitted into bore 22. Snap ring 90 secures choke 85 within ball member 21. Preferably, the outside diameter of choke 85 is sized to allow choke 85 to be installed through support sleeve 27 and opening 95 without having to disassemble valve 10. Chokes 85 with various sizes of restricted orifice 86 are available for the desired formation fluid flow rate through valve 10. For some high flow rates, it may not even be necessary to place a flow regulating means within bore 22.

OPERATING SEQUENCE

Figure 2C:
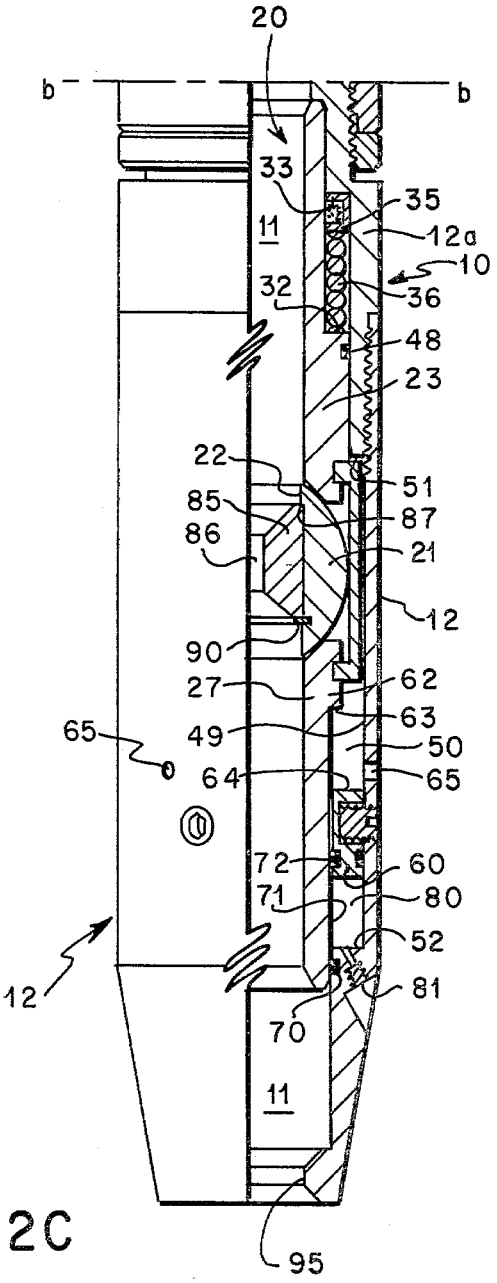
FIG. 2C, partially in section and partially in elevation, shows the valve closure means in its second position allowing fluid flow therethrough.

Valve 10 is secured to locking mandrel 42 at the well surface and installed within landing nipple 40 by conventional pumpdown techniques. The first position of valve closure means 20, when subjected to only atmospheric pressure, is defined by ball member 21 being rotated so that bore 22 is perpendicular to longitudinal flow passage 11. Spring 36 biases ball member 21 to this position. After valve 10 is installed, packing 45 prevents fluid communication between the exterior of locking mandrel 42 and the inside diameter of landing nipple 40. By conventional techniques such as swabbing the bore of the tubing string above valve 10, a lower fluid pressure on one side of ball member 21 can be created as compared to formation fluid pressure on the other side of ball member 21. This difference in pressure creates a net force on ball member 21 and operating sleeve 23 to compress spring 36 and move valve closure means 20 in the one direction. Movement in the one direction causes ball member 21 to rotate aligning bore 22 with longitudinal flow passage 11 and allowing fluid flow therethrough. This is the second position of valve closure means 20 as shown in FIG. 2C. Choke 85 acts as a restriction to fluid flow through bore 22 in the one direction resulting in a pressure drop or difference in pressure in the one position to hold valve closure means 20 in its second position against the force of spring 36.

When the flow rate through choke 85 drops below a preselected value, spring 36 acts on operating sleeve 23 to move operating sleeve 23 longitudinally in the other direction and return valve closure means 20 to its first position. A decrease in flow rate in the one direction could be caused by shutting in the well at the surface.

One reason to shut in the well might be a need to pump fluids into the bore of the well flow conductor above valve 10. With valve closure means 20 in its first position, the engagement of ball member 21 with sealing surface 53 and first seal 48 with inside diameter 19 cooperate to prevent fluids injected into the one end of flow passage 11 from the well surface from flowing out opening 95 and into the surrounding formation.

Valve closure means 20 will remain in its first position until the pressure of fluid, injected into longitudinal flow passage 11, on the one side of ball member 21 exceeds a preselected value as compared to the pressure of formation fluid on the other side of ball member 21. When this difference in pressure in the other direction exceeds a preselected value, screws 61 will shear releasing ring 60 from the inside diameter of housing 12. The difference in pressure in the other direction will then move valve closure means 20 to its third position with ring 60 resting on shoulder 52. Movement to the third position occurs at a controlled rate depending upon the viscosity of the fluid in variable volume chamber 80 and the size of opening 81. Screws 61 are selected to require considerable force to release ring 60 from housing 12 to prevent accidentally moving valve closure means 20 to its third position. This same force would generate considerable momentum as valve closure means 20 moves towards shoulder 52 if the high viscosity liquid in variable volume chamber 80 did not dampen the force. Ring 60 with third seal 72 and fourth seal 73 acts as a dash pot within chamber 80 to dampen the forces when movement of valve closure means 20 is stopped by shoulder 52.

When valve closure means 20 is in its third position resting on shoulder 52, first seal 48 is moved longitudinally into recess 50. As previously noted, inside diameter 49 of recess 50 is larger than inside diameter 19 of housing 12. First seal 48 does not contact the inside diameter of housing 12 when valve closure means 20 is in its third position. An alternative fluid communication path is thus established from longitudinal flow passage 11, between the exterior of operating sleeve 23 and the inside diameter of housing 12, recess 50 and lateral ports 65 to the exterior of valve 10 when valve closure means 20 is in its third position.

A valve incorporating the present invention can be used to allow fluid flow in one direction and prevent fluid flow in the other direction until the valve closure means is shifted to its third position. The previous description is illustrative of only one embodiment of the present invention. Those skilled in the art will readily see other variations for a valve utilizing the present invention. Such changes, variations, and modifications may be made without departing from the scope of the invention which is defined by the claims.

What is claimed is:

1. A valve for controlling fluid flow through a well flow conductor, comprising:

a. a housing;

b. means for securing the housing to the flow conductor;

c. a longitudinal flow passage extending through the housingl;

d. a valve closure means, disposed within the longitudinal flow passage, having a first position blocking fluid flow therethrough, a second position allowing fluid communication through the longitudinal flow passage and the valve closure means, and a third position allowing fluid to communicate between the longitudinal flow passage and the exterior of the housing;

e. an operating sleeve, slidably disposed within the longitudinal flow passage, forming a part of the valve closure means to shift the valve closure means between its first and second positions;

f. means for biasing the operating sleeve to shift the valve closure means to its first position; and g. means for forming a seal with the valve closure means preventing fluid flow in the other direction through the longitudinal flow passage when the valve closure means is in its first position and allowing fluid to communicate between the longitudinal flow passage and the exterior of the housing when the valve closure means is in its third position.

2. A valve, as defined in claim 1, further comprising:

a. a first seal, carried on the exterior of the operating sleeve, preventing fluid flow between the exterior of the operating sleeve and the inside diameter of the housing when the valve closure means is in its first and second positions;

b. a recess formed within the inside diameter of the housing and longitudinally spaced from the first seal during movement of the valve closure means between its first and second positions;

c. lateral ports extending through the housing within the recess;

d. means for releasing the sealing means when the valve closure means is in its first position and the difference in pressure across the valve closure means in the other direction exceeds a preselected value; and e. the difference in pressure in the other direction moving the valve closure means longitudinally to its third position.

3. A valve, as defined in claim 2, wherein the valve closure means further comprises:

a. a rotatable ball member which is sized to engage the sealing means to prevent fluid flow in the other direction when the valve closure means is in its first position; and b. a bore through the ball member which is aligned with the longitudinal flow passage when the valve closure means is in its second position.

4. A valve, as defined in claim 3, wherein the sealing means further comprises:

a. a support sleeve, slidably disposed within the longitudinal flow passage, axially aligned with the operating sleeve, and engaging the ball member opposite the operating sleeve;

b. one end of the support sleeve having a first sealing surface to engage the exterior of the ball member;

c. a flange formed on the one end of the support sleeve and projecting into the recess;

d. a first shoulder on the flange within the recess facing in the other direction;

e. a releasing ring secured to the inside diameter of the housing within the recess by shear screws and providing a second shoulder facing in the one direction to engage the first shoulder;

f. the shear screws anchoring the releasing ring to the housing while the valve closure means moves between its first and second positions; and g. the shear screws being selected to allow the releasing ring to move relative to the housing when the difference in pressure across the ball member in the other direction exceeds a predetermined value.

5. A valve, as defined in claim 4, wherein the sealing means further comprises:

a. a second seal, carried by the inside diameter of the housing, spaced longitudinally from the recess, and contacting the support sleeve to prevent fluid flow between the support sleeve and the inside diameter of the housing;

b. a third seal on the inside diameter of the releasing ring and engaging the exterior of the support sleeve;

c. a fourth seal carried on the outside diameter of the releasing ring and engaging the inside diameter of the housing within the recess;

d. the second, third, and fourth seals, the exterior of the support sleeve and a portion of the recess partially defining a variable volume chamber; and e. an opening from the exterior of the housing into the variable volume chamber.

6. A valve, as defined in claim 5, further comprising:

a. a high viscosity liquid filling the variable volume chamber; and b. the opening allowing the releasing ring to extrude the liquid from the variable volume chamber when the valve closure means moves to its third position.

7. A valve as defined in claim 6, further comprising the operating sleeve and support sleeve being generally cylindrical and each having an inside diameter which corresponds to the unrestricted inside diameter of the bore in the ball member.

8. A valve as defined in claim 3, wherein the operating sleeve further comprises:

a. a second sealing surface formed on the end of the operating sleeve containing the ball member; and b. the sealing surface preventing flow between the exterior of the ball member and the one end of the operating sleeve.

9. A valve, as defined in claim 1, wherein the biasing means further comprises a spring disposed between a shoulder on the exterior of the operating sleeve facing in the one direction and a shoulder on the inside diameter of the housing facing in the other direction.

10. A valve, as defined in claim 1, further comprising means for dampening the forces acting on the valve closure means when the valve closure means moves to its third position.

11. A standing valve for controlling fluid flow through a well flow conductor, comprising:

a. a housing;

b. a longitudinal flow passage extending through the housing;

c. means for securing the housing to the flow conductor with the bore of the flow conductor communicating with the longitudinal flow passage;

d. a valve closure means, disposed within the longitudinal flow passage, having a first position blocking fluid flow therethrough, a second position allowing fluid communication through the longitudinal flow passage and the valve closure means, and a third position allowing fluid to communicate between the longitudinal flow passage and the exterior of the housing;

e. an operating sleeve, slidably disposed within the longitudinal flow passage, forming a part of the valve closure means to shift the valve closure means between its first and second positions;

f. means for biasing the operating sleeve to shift the valve closure means to its first position when the differential pressure created by fluid flowing in one direction through the valve closure means decreases below a preselected value;

g. means for forming a seal with the valve closure means preventing fluid flow in the other direction through the longitudinal flow passage when the valve closure means is in its first position;

h. means for releasing the sealing means when the valve closure means is in its first position and the difference in pressure across the valve closure means in the other direction exceeds a preselected value; and i. the difference in pressure in the other direction moving the valve closure means longitudinally to its third position.

12. A standing valve, as defined in claim 11, further comprising:

a. a first seal, carried on the exterior of the operating sleeve, preventing fluid flow between the exterior of the operating sleeve and the inside diameter of the housing when the valve closure means is in its first and second positions;

b. a recess formed within the inside diameter of the housing and longitudinally spaced from the first seal during movement of the valve closure means between its first and second positions; and c. lateral ports extending through the housing within the recess.

13. A standing valve, as defined in claim 12, wherein the sealing means further comprises:

a. a support sleeve, slidably disposed within the longitudinal flow passage, axially aligned with the operating sleeve, and engaging the ball member opposite the operating sleeve;

b. one end of the support sleeve having a first sealing surface to engage the exterior of the ball member;

c. a flange formed on the one end of the support sleeve and projecting into the recess;

d. a first shoulder on the flange within the recess facing in the other direction;

e. a releasing ring secured to the inside diameter of the housing within the recess by shear screws and providing a second shoulder facing in the one direction to engage the first shoulder;

f. the shear screws anchoring the releasing ring to the housing while the valve closure means moves between its first and second positions; and g. the shear screws being selected to allow the releasing ring to move relative to the housing when the difference in pressure across the ball member in the other direction exceeds a predetermined value.

14. A standing valve, as defined in claim 13, further comprising:

a. a second seal, carried by the inside diameter of the housing, spaced longitudinally from the recess, and contacting the support sleeve to prevent fluid flow between the support sleeve and the inside diameter of the housing;

b. a third seal carried on the inside diameter of the releasing ring and engaging the exterior of the support sleeve;

c. a fourth seal carried on the outside diameter of the releasing ring and engaging the inside diameter of the housing within the recess;

d. the second, third, and fourth seals, the exterior of the support sleeve and a portion of the recess partially defining a variable volume chamber;

e. an opening from the exterior of the housing into the variable volume chamber;

f. a high viscosity liquid filling the variable volume chamber; and g. the opening allowing the releasing ring to extrude the liquid from the variable volume chamber when the valve closure means moves to its third position.

15. A standing valve, as defined in claim 11, wherein the ball member further comprises:

a. an axial bore therethrough;

b. a flow restricting means secured within the axial bore; and c. the inside diameter of the longitudinal flow passage and the outside diameter of the flow restricting means sized to allow removal of the flow restricting means from the axial bore through the longitudinal flow passage.

16. A standing valve, as defined in claim 11, further comprising means for dampening the forces acting on the valve closure means when the valve closure means moves to its third position.

* * * * *